US005205407A

United States Patent [19]

Tu

[11] Patent Number: 5,205,407

[45] Date of Patent: Apr. 27, 1993

[54] CASE FOR RECEIVING PAPER CLIPS, PINS OR THE LIKE

[75] Inventor: Charlie Tu, Taipei, Taiwan

[73] Assignee: C&T Products Corp., Taipei City, Taiwan

[21] Appl. No.: 867,858

[22] Filed: Apr. 13, 1992

[51] Int. Cl.[5] ..... B65D 85/24

[52] U.S. Cl. ..... 206/338

[58] Field of Search ..... 206/338, 336, 536

[56] References Cited

U.S. PATENT DOCUMENTS

| | | | |
|---|---|---|---|
| 1,775,959 | 9/1930 | Himes | 206/536 X |
| 2,903,127 | 9/1959 | Dorman | 206/338 |
| 3,750,868 | 8/1973 | Cooper | 206/338 |
| 4,058,209 | 11/1977 | Schmidt | 206/338 X |

*Primary Examiner*—William I. Price
*Attorney, Agent, or Firm*—Matthew K. Ryan

[57] ABSTRACT

A case for receiving paper clips, pins or the like includes a pan having a bottom, a peripheral wall extending upwardly from the bottom and an open top. An upper cover covers the open top and is rotatably mounted to the pan. The pan and the upper cover define a receiving space for receiving the paper clips, pins or the like. The upper cover includes a top wall having an eccentric opening and a shoveling portion integral with the top wall and extending from a portion of a periphery of the opening toward the bottom of the pan in a circumferential direction. The paper clips, the pins or the like are shoveled into the shoveling portion when the upper cover is rotated relative to the pan in a first direction. The paper clips, the pins or the like are put into the receiving space through the opening when the upper cover is rotated relative to the pan in a second direction opposite to the first direction.

5 Claims, 5 Drawing Sheets

CASE FOR RECEIVING PAPER CLIPS, PINS OR THE LIKE

BACKGROUND OF THE INVENTION

1. Field of the Invention

This invention relates to a case, more particularly to an improved case for receiving paper clips, pins or the like.

2. Description of the Related Art

Conventional clip cases (a, b) are shown in FIGS. 1 to 4. A first conventional clip case (a) includes a box (1*a*) provided with a recessed portion (11*a*). Clips (2*b*) can be received in the recessed portion (11*a*). Since the recessed portion (11*a*) is exposed to the atmosphere, untimely removal of the clips (2*b*) which are received therein easily occurs. A second conventional clip case (b) includes a base (1*b*) having an open top and defining a receiving space for receiving clips (5*b*) therein. A pair of rollers (21*b*, 22*b*) are connected by a joint member (23*b*) and have magnetic members (25*b*) provided therein. The rollers (21*b*, 22*b*) are mounted on the base (1*b*) adjacent to the receiving space at a front end of the base (1*b*). A cover (34*b*) extends from a rear end of the base (1*b*) toward the front end of the base (1*b*) to cover the open top of the base (1*b*). The cover (34*b*) and the rollers (21*b*, 22*b*) cooperatively define a passage (A). The clips (5*b*) in the receiving space are attracted onto the rollers (21*b*, 22*b*) and transported through the passage (A) when the rollers (21*b*, 22*b*) are rotated in a predetermined direction. In actual practice, a plurality of clips (5*b*) are attracted onto the rollers (21*b*, 22*b*) and are simultaneously transported through the passage (A). This can cause blockage of the passage (A), thereby making it difficult to get clips (5*b*) from the clip case (b).

SUMMARY OF THE INVENTION

Therefore, the objective of this invention is to provide an improved case for receiving paper clips, pins or the like. The paper clips, pins or the like can be conveniently stored and retrieved from the improved case.

Accordingly, a case for receiving paper clips, pins or the like includes a pan having a bottom, a peripheral wall extending upward from the bottom and an open top. An upper cover covers the open top and is rotatably mounted to the pan. The pan and the upper cover define therebetween a receiving space for receiving the paper clips, pins or the like. The upper cover includes a top wall having an eccentric opening and a shoveling portion integral with the top wall and extending from a portion of a periphery of the opening toward the bottom of the pan in a circumferential direction. The paper clips, the pins or the like are shoveled into the shoveling portion when the upper cover is rotated relative to the pan in a first direction. The paper clips, the pins or the like are put into the receiving space through the opening when the upper cover is rotated relative to the pan in a second direction opposite to the first direction.

BRIEF DESCRIPTION OF THE DRAWING

Other features and advantages of the present invention will become apparent in the following detailed description of the preferred embodiments, with reference to the accompanying drawings, of which.

DETAILED DESCRIPTION OF THE INVENTION

Figure 1:
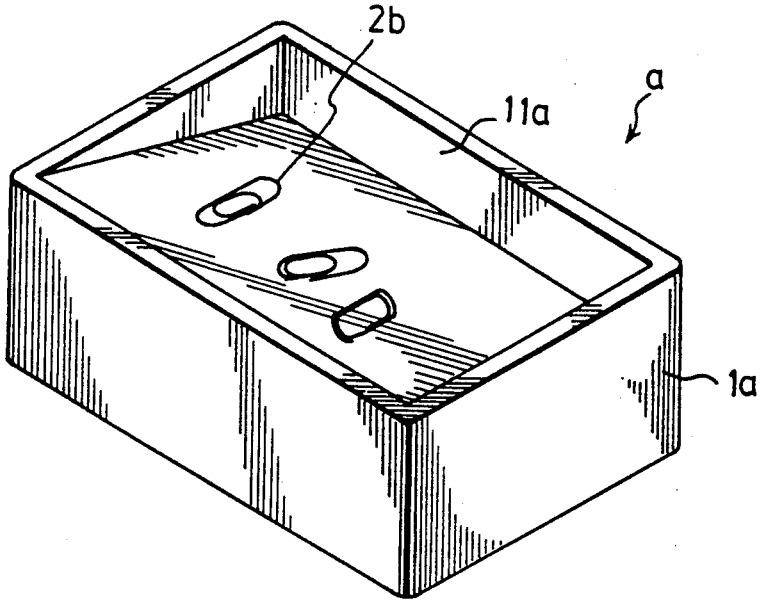
PRIOR ART FIG. 1
FIG. 1 is a perspective view of a first conventional clip case.
Figure 2:
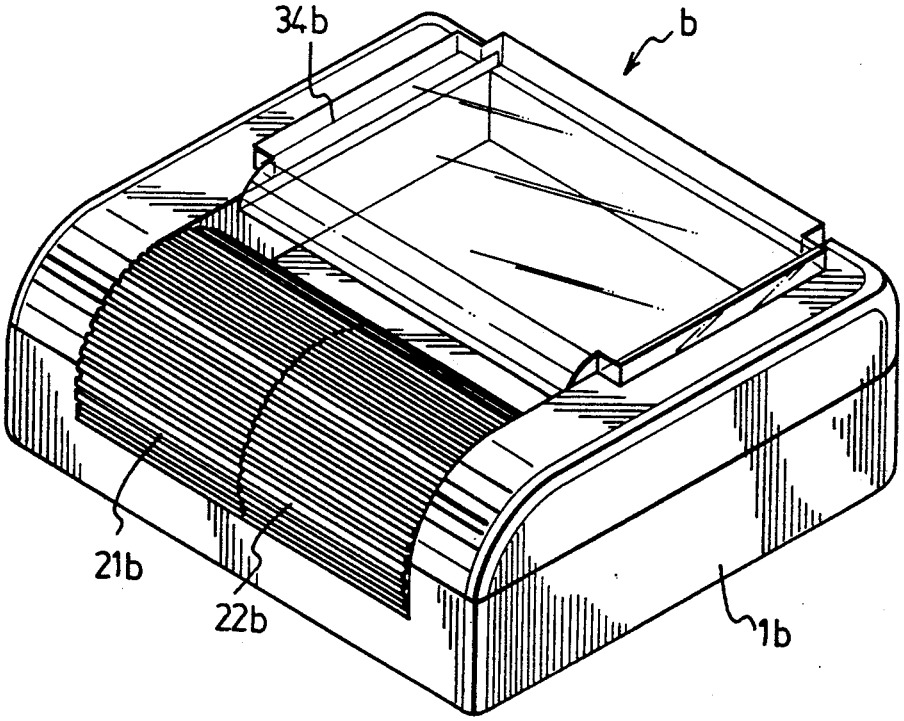
PRIOR ART FIG. 2
FIG. 2 is a perspective view of a second conventional clip case.
Figure 3:
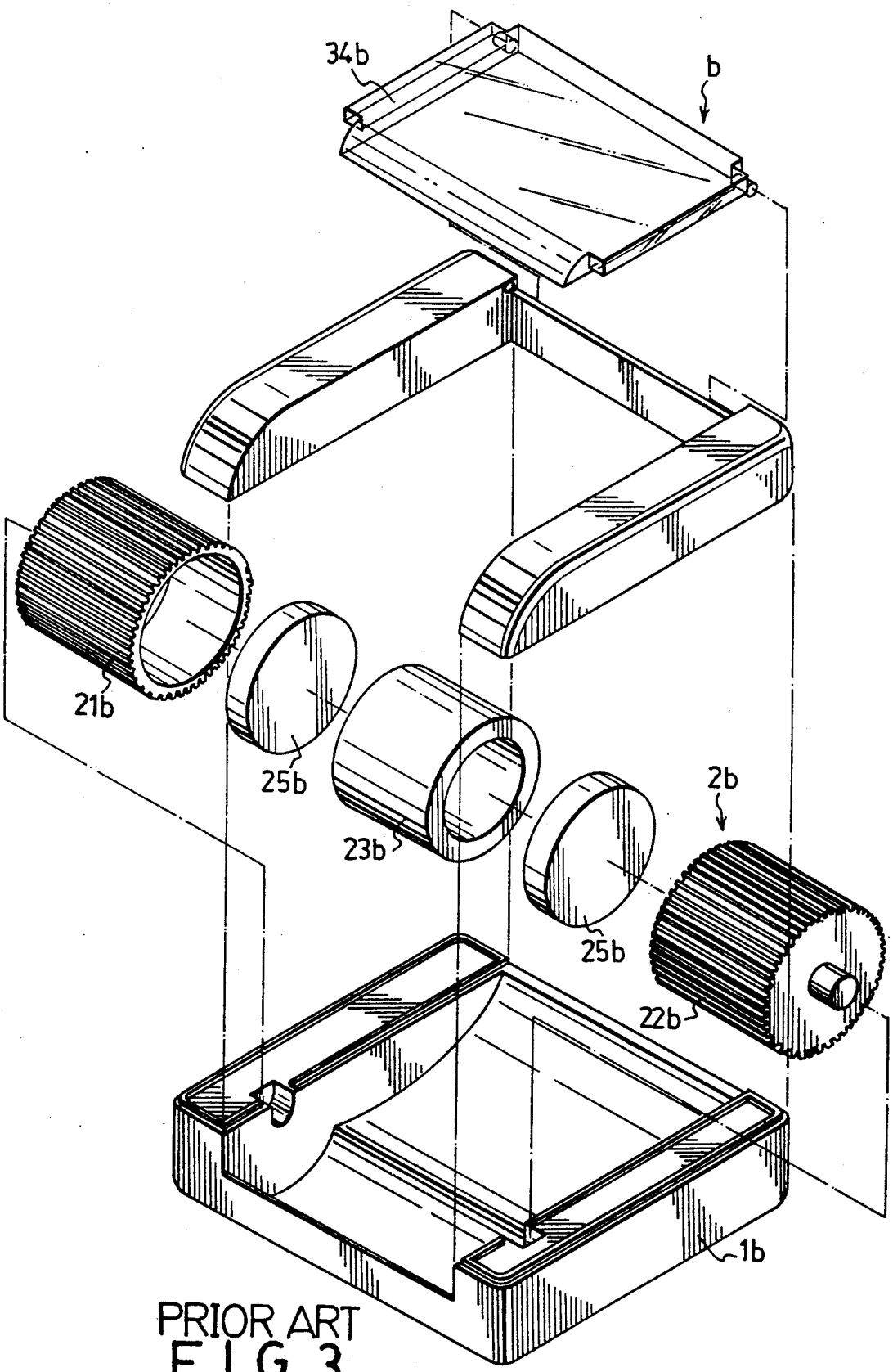
PRIOR ART FIG. 3
FIG. 3 is an exploded view of the second conventional clip case.
Figure 4:
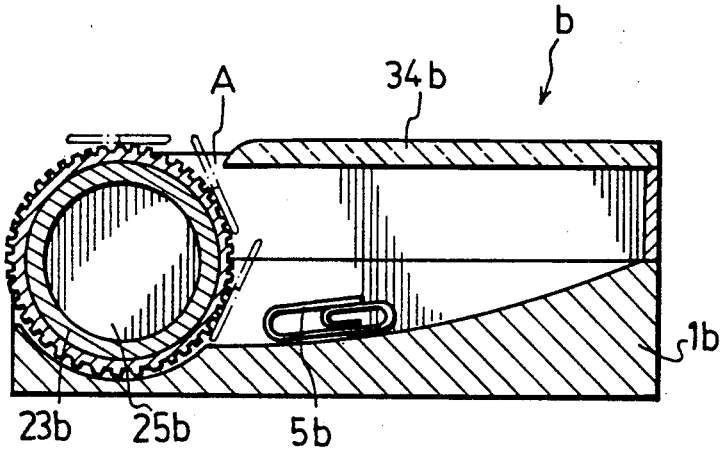
PRIOR ART FIG. 4
FIG. 4 is a sectional view of the second conventional clip case.
Figure 5:
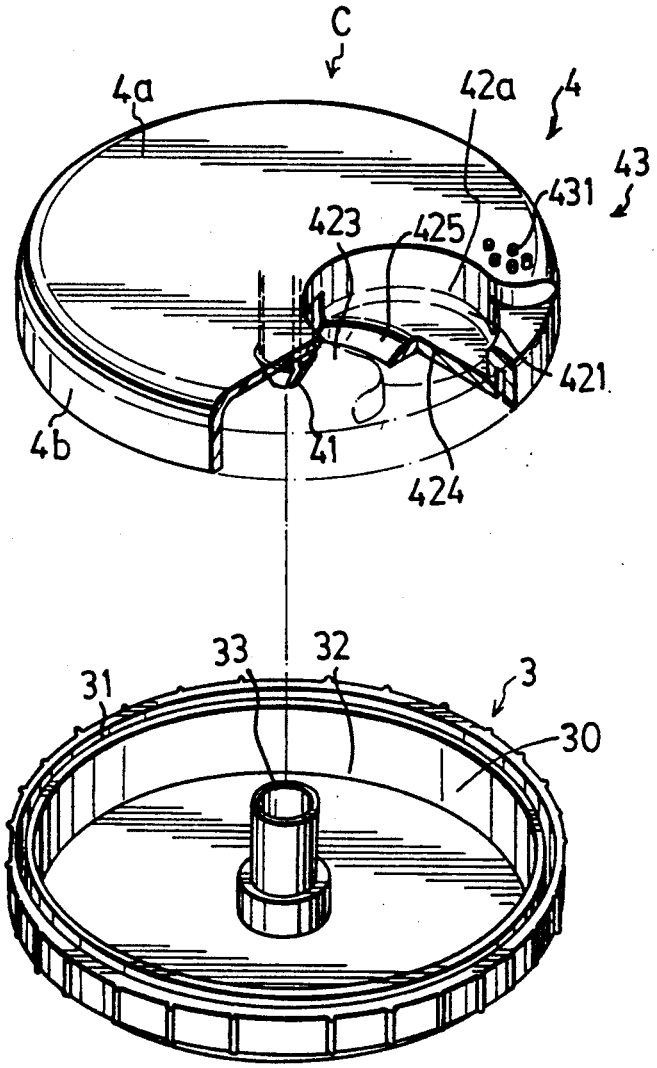
FIG. 5 is an exploded view of an improved case of this invention.
Figure 6:
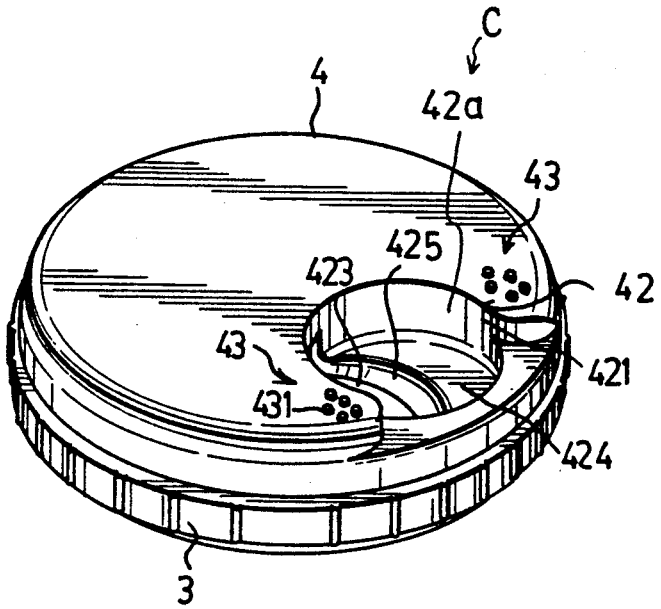
FIGS. 6 and 7 are perspective views of the improved case of this invention.
Figure 7:
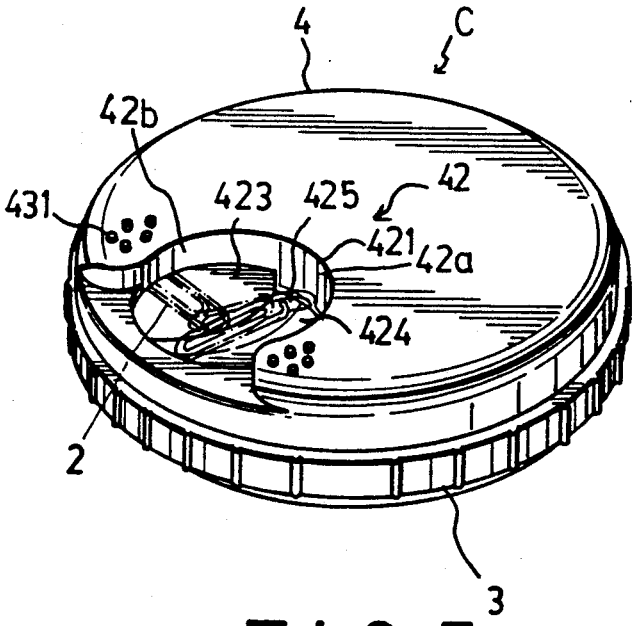

Referring to FIGS. 5 to 7, an improved case (c) of this invention for receiving paper clips, pins or the like includes a circular pan (3) having a bottom (32), a peripheral wall (30) extending upward from the bottom (32) and an open top. The peripheral wall (30) has a looped groove (31) formed on a top edge of the peripheral wall (30). The pan (3) has an axle seat (33) mounted on the center of the bottom (32). A circular upper cover (4) includes a top wall (4*a*), a peripheral wall (4*b*) extending downward from the top wall (4*a*) and a rotating shaft (41) extending downward from the center of the top wall (4*a*). The rotating shaft (41) is journaled in the axle seat (33), and the peripheral wall (4*b*) of the cover (4) slidably engages the peripheral wall (31) of the pan (3) when the cover (4) is mounted on the open top of the pan (3). The pan (3) and the cover (4) define therebetween a receiving space for receiving paper clips (2). The top wall (4*a*) has an eccentric circular opening (421) and a shoveling portion (42) integral with the top wall (4*a*). The shoveling portion (42) includes a first flange (42*a*) extending axially downward from a portion of a periphery of the opening (421) and a flat member (424) extending from the first flange (42*a*) toward the opening (421). The flat member (424) is parallel to the bottom (32) and slidably abuts the same. The flat member (424) has a curved tapered edge (425). The cover (4) further includes a second flange (42*b*) extending axially downwardly from another portion of the periphery of the opening (421) and defining a notch (423) opposite to the shoveling potion (42) to communicate the receiving space and the opening (421). The cover (4) has a pushing unit (43) including a plurality of protrusions (431) provided adjacent to the opening (421) and projecting upwardly from the top wall (4*a*) for facilitating the rotation of the cover (4). The paper clips (2) are shoveled into the shoveling portion (42) from the receiving space through the notch (423) when a user pushes the protrusions (431) to cause the cover (40) to be rotated relative to the pan (3) in a clockwise direction. The paper clips (2) are put into the receiving space via the shoveling portion (42) through the notch (423) when the user pushes the protrusions (431) to cause the cover (40) to be rotated relative to the pan (3) in an anticlockwise direction.

Therefore, the paper clips, pins or the like can be conveniently stored in and retrieved from the improved case (c).

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangements.

I claim:

1. A case for receiving paper clips and pins comprising:

a pan having a bottom, a peripheral wall extending upwardly from said bottom and an open top;

an upper cover covering said open top and being rotatably mounted to said pan, said pan and said upper cover defining therebetwen a receiving space for receiving said paper clip and said pins, said upper cover including a top wall having an eccentric opening and a shoveling portion integral with said top wall and extending from a portion of a periphery of said opening toward said bottom of said pan in a circumferential direction, said paper clips and said pins being shoveled into said shoveling portion when said upper cover is rotated relative to said pan in a first direction, said paper clips and said pins being put into said receiving space through said opening when said upper cover is rotated relative to said pan in a second direction opposite to said first direction.

2. A case as claimed in claim 1, wherein said pan is substantially circular in shape, said upper cover being substantially circular in shape.

3. A case as claimed in claim 1, wherein said opening of said top wall of said upper cover is circular in shape, said shoveling portion including a flange extending axially downwardly from said portion of said periphery of said opening and a flat member extending from said flange toward said opening, said flat member being parallel to and slidably abutting said bottom of said pan, said flat member having a tapered edge.

4. A case as claimed in claim 1, wherein said upper cover further includes a pushing unit mounted thereon to facilitate the rotation of said upper cover.

5. A case as claimed in claim 4, wherein said pushing unit includes a plurality of protrusions projecting upwardly from said top wall of said upper cover.

* * * * *